US009424805B2

(12) United States Patent
Lee et al.

(10) Patent No.: US 9,424,805 B2
(45) Date of Patent: Aug. 23, 2016

(54) DISPLAY DRIVE INTEGRATED CIRCUIT AND IMAGE DISPLAY SYSTEM CAPABLE OF CONTROLLING A SELF-REFRESH DISPLAY

(71) Applicant: SAMSUNG ELECTRONICS CO., LTD., Suwon-si, Gyeonggi-do (KR)

(72) Inventors: Jong-Sung Lee, Seoul (KR); Se-Moon Oh, Suwon-si (KR); Byung-Koan Kim, Suwon-si (KR); Dustin Yuk Lun Wai, Seongnam-si (KR); Hye-Jin Jung, Hwaseong-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 184 days.

(21) Appl. No.: 14/198,001

(22) Filed: Mar. 5, 2014

(65) Prior Publication Data

US 2014/0253537 A1 Sep. 11, 2014

(30) Foreign Application Priority Data

Mar. 7, 2013 (KR) ..... 10-2013-0024236

(51) Int. Cl.

| | |
|---|---|
| ***G09G 3/36*** | (2006.01) |
| ***G09G 5/12*** | (2006.01) |
| ***G09G 5/00*** | (2006.01) |

(52) U.S. Cl.

CPC ..... *G09G 5/12* (2013.01); *G09G 5/003* (2013.01); *G09G 5/006* (2013.01); *G09G 2320/103* (2013.01); *G09G 2330/021* (2013.01); *G09G 2360/18* (2013.01); *G09G 2370/04* (2013.01); *G09G 2370/10* (2013.01)

(58) Field of Classification Search

CPC ..... G09G 5/12; G09G 5/003; G09G 5/006
USPC ..... 345/100, 214
See application file for complete search history.

(56) References Cited

U.S. PATENT DOCUMENTS

| | | | | |
|---|---|---|---|---|
| 6,970,163 | B2 | 11/2005 | Cairns et al. | |
| 7,030,871 | B2 | 4/2006 | Kitagawa et al. | |
| 7,768,492 | B2 | 8/2010 | Sakamaki et al. | |
| 2005/0200628 | A1 * | 9/2005 | Feng | G06F 13/4243 345/530 |

(Continued)

FOREIGN PATENT DOCUMENTS

| | | |
|---|---|---|
| JP | 2005-534047 | 11/2005 |
| KR | 1020120008149 | 1/2012 |

OTHER PUBLICATIONS

WO03/100759—abstract page—corresponds to JP2005-534047.

*Primary Examiner* — Jonathan Blancha
(74) *Attorney, Agent, or Firm* — F. Chau & Associates, LLC

(57) ABSTRACT

A display drive integrated circuit includes a frame buffer, an output selector and a timing controller. The output selector selectively outputs one of image data read from the frame buffer and image data transmitted from a source external to the display drive integrated circuit. The timing controller controls output of the image data read from the frame buffer to the display panel in a self-refresh mode, and controls internal display timing to track external display timing when the display drive integrated circuit exits from the self-refresh mode to control the output selector to output the image data transmitted from the source to the display panel when the internal display timing is synchronized to the external display timing.

17 Claims, 7 Drawing Sheets

(56) References Cited

U.S. PATENT DOCUMENTS

2007/0222774 A1 9/2007 Foster
2009/0079746 A1* 3/2009 Howard ..... G06F 1/3218 345/502
2011/0115781 A1 5/2011 Park et al.
2011/0157198 A1* 6/2011 Vasquez ..... G09G 5/003 345/531
2013/0235014 A1* 9/2013 Lee ..... G06F 1/32 345/211

* cited by examiner

DISPLAY DRIVE INTEGRATED CIRCUIT AND IMAGE DISPLAY SYSTEM CAPABLE OF CONTROLLING A SELF-REFRESH DISPLAY

CROSS-REFERENCE TO RELATED APPLICATION

This application claims priority under 35 USC §119 to Korean Patent Application No. 10-2013-0024236, filed on Mar. 7, 2013, in the Korean Intellectual Property Office (KIPO), the disclosure of which is incorporated by reference in its entirety herein.

BACKGROUND

1. Technical Field

Exemplary embodiments of the inventive concept relate generally to a display drive integrated circuit (hereinafter, referred to as "display drive IC") and an image display system, and more particularly to a display drive IC and an image display system capable of controlling a self-refresh display.

2. Discussion of Related Art

A smart phone may include a high resolution display, which receives an image signal from a host through a display drive IC to display the image signal. However, when the display receives a still image from the host, power may be consumed unnecessarily.

A panel self-refresh (PSR) technology may be used to display an image while minimizing power consumption using a memory installed in a display, thereby significantly increasing a usable time of a battery in a portable environment.

However, screen flickering may occur when an image is displayed using the PSR technology. Further, the screen flickering may deteriorate the quality of the displayed image.

SUMMARY

At least one exemplary embodiment of the inventive concept provides a display drive IC and an image display system, capable of preventing screen flickering by controlling a frame rate in response to timing of an input image.

At least one exemplary embodiment of the inventive concept provides a display drive IC and an image display system, capable of improving an image display quality.

According to an exemplary embodiment of the inventive concept, a display drive integrated circuit includes a frame buffer, an output selector and a timing controller. The output selector selectively outputs one of image data read from the frame buffer and image data transmitted from a source external to the display drive integrated circuit. The timing controller controls output of the image data read from the frame buffer to the display panel in a self-refresh mode, and controls internal display timing to track external display timing when the display drive integrated circuit exits the self-refresh mode to control the output selector to output the image data transmitted from the source to the display panel when the internal display timing is synchronized to the external display timing.

In an exemplary embodiment, the timing controller controls the output selector to output the image data transmitted from the source to the display panel in a state where the external display timing is synchronized with the internal display timing by extending a vertical blank interval of the internal display timing by a first time difference between the external display timing and the internal display timing when the first time difference is less than a first threshold value, and the timing controller stores the image data transmitted from the source in the frame buffer and controls the output selector to output the image data transmitted from the source to the display panel in a state where a frame read rate from the frame buffer is synchronized with a frame transmission rate of the image data transmitted from the source by one of increasing and reducing the frame read rate from the frame buffer to track the frame transmission rate of the image data transmitted from the source in response to a second time difference between the external display timing and the internal display timing when the second time difference is equal to or greater than the first threshold value.

The timing controller may store image data transmitted from the source in the frame buffer and control the output selector to output the image data transmitted from the source to the display panel in a state where the frame read rate from the frame buffer is synchronized with the frame transmission rate of the image data transmitted from the source by reducing the frame read rate read from the frame buffer to be lower than the frame transmission rate of the image data transmitted from the source when the second time difference is equal to or greater than the first threshold value and is less than the second threshold value, and the timing controller may store image data transmitted from the source in the frame buffer and control the output selector to output the image data transmitted from the source to the display panel in a state where the frame read rate from the frame buffer is synchronized with the frame transmission rate of the image data transmitted from the source by increasing the frame read rate from the frame buffer to be greater than the frame transmission rate of the image data transmitted from the source when the second time difference is equal to or greater than the second threshold value.

The first threshold value may be a maximum vertical blank interval allowed for one frame interval when a vertical blank interval is extended.

The second threshold value may be an interval where a maximum vertical blank interval obtained when the vertical blank interval is extended to reduce a frame rate to be lower than the frame transmission rate of image data transmitted from the source is set as a flickering interval.

According to an exemplary embodiment of the inventive concept, an image display system includes an image display device and a host. The host controls the image display device to operate in a self-refresh mode when the image display device displays a still image. The image display device includes a display panel and a display drive integrated circuit. The display panel displays an image. The display drive integrated circuit displays the still image on the display panel with internal display timing in the self-refresh mode, and drives the display panel according to image data transmitted from the host such that the internal display timing is synchronized with display timing of image data transmitted from the host by controlling the internal display timing to track the display timing of the image data when the image display device exits the self-refresh mode.

In an exemplary embodiment, the display drive integrated circuit includes a frame buffer, an output selector and a timing controller. The output selector may selectively output one of image data read from the frame buffer and image data transmitted from a source external to the display drive integrated circuit. The timing controller may output the image data read from the frame buffer to a display panel in a self-refresh mode, and control internal display timing to track external display timing when the display drive integrated circuit exits the self-refresh mode to control the output selector to output the image transmitted from the source to the display panel when the internal display timing is synchronized to the external display timing.

The timing controller may control the output selector to output the image data transmitted from the source to the display panel in a state that the external display timing is synchronized with the internal display timing by extending a vertical blank interval of the internal display timing by a first time difference between the external display timing and the internal display timing when the first time difference is less than a first threshold value, and the timing controller may store the image data transmitted from the source in the frame buffer and control the output selector to output the image data transmitted from the source to the display panel in a state where a frame read rate from the frame buffer is synchronized with the frame transmission rate of the image data transmitted from the source by one of increasing and reducing the frame read rate from the frame buffer to track the frame rate of the image data transmitted from the source in response to a second time difference between the external display timing and the internal display timing when the second time difference is equal to or greater than the first threshold value.

The timing controller may store image data transmitted from the outside in the frame buffer and controls the output selector to output the image data transmitted from the outside to the display panel in a state that the frame rate read from the frame buffer is synchronized with the frame rate of the image data transmitted from the source by reducing the frame read rate from the frame buffer to be lower than the frame transmission rate of the image data transmitted from the source when the second time difference is equal to or greater than the first threshold value and is less than the second threshold value, and the timing controller may store image data transmitted from the source in the frame buffer and control the output selector to output the image data transmitted from the source to the display panel in a state where the frame read rate from the frame buffer is synchronized with the frame transmission rate of the image data transmitted from the source by increasing the frame read rate from the frame buffer to be greater than the frame transmission rate of the image data transmitted from the source when the second time difference is equal to or greater than the second threshold value.

The first threshold value may be a maximum vertical blank interval allowed for one frame interval when a vertical blank interval is extended.

The second threshold value may be an interval where a maximum vertical blank interval obtained when the vertical blank interval is extended to reduce a frame rate to be lower than the frame transmission rate of image data transmitted from the source is set as a flickering interval.

The host may be connected to the display drive integrated circuit through a display port interface or an embedded display port interface.

According to an exemplary embodiment of the inventive concept, a display drive integrated circuit includes a controller and a frame buffer. The controller is configured to receive external image data and determine a timing based on the received image data. The frame buffer is configured to receive the external image data. The controller is configured to perform one of i) forwarding of the external image data to a display panel or ii) storing the external image data in the frame buffer, reading of the image data from the frame buffer, and forwarding of the read image data to the display panel, based on the determined timing.

In an exemplary embodiment, the controller determines the timing by comparing the received image data to the forwarded image data to determine a difference. In an exemplary embodiment, the difference is less than a first threshold, the controller forwards the external image data to the display panel, and otherwise stores the external image data in the frame buffer, reads the image data from the frame buffer, and forwards the read image data to the display panel. In an exemplary embodiment, when the difference is greater than the first threshold and less than a second threshold, the controller reads the image data from the frame buffer at a rate higher than a rate at which the external image data is received. In an exemplary embodiment, when the difference is greater than the second threshold and less than a third threshold, the controller reads the image data from the frame buffer at a rate lower than a rate at which the external image data is received. In an exemplary embodiment, the display drive integrated circuit further includes a multiplexer configured to receive the external image data and an output of the frame buffer, and is controlled by a control signal based on the timing. In an exemplary embodiment, the controller only performs the storing, reading, and forwarding upon exiting a self-refresh mode.

BRIEF DESCRIPTION OF THE DRAWINGS

Exemplary embodiments of the inventive concept will be more clearly understood from the following detailed description taken in conjunction with the accompanying drawings.

DETAILED DESCRIPTION

Figure 1:
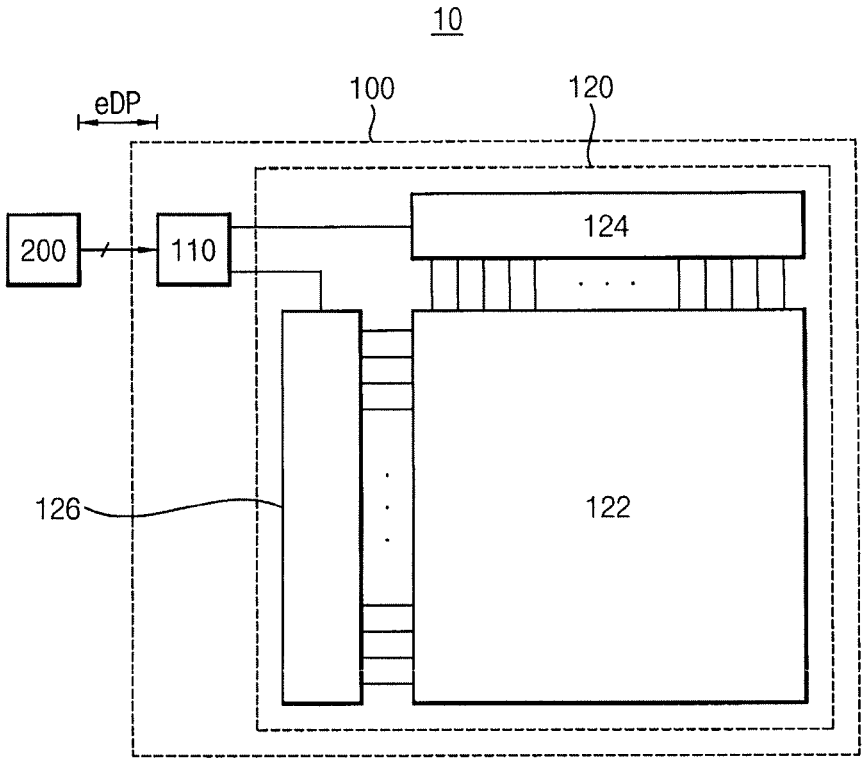
FIG. 1 is a block diagram illustrating an image display system according to an exemplary embodiment of the inventive concept.

The inventive concept will be described more fully with reference to the accompanying drawings, in which exemplary embodiments thereof are shown. The present inventive concept may, however, be embodied in many different forms and should not be construed as limited to the embodiments set forth herein. Like reference numerals refer to like elements throughout this application.

It will be understood that when an element is referred to as being "connected" or "coupled" to another element, it can be directly connected or coupled to the other element or intervening elements may be present. As used herein, the singular forms "a," "an" and "the" are intended to include the plural forms as well, unless the context clearly indicates otherwise.

FIG. 1 is a block diagram illustrating an image display system according to an exemplary embodiment of the inventive concept.

Referring to FIG. 1, the image display system 10 according to an exemplary embodiment of the inventive concept includes a sync unit 100 and a source unit 200.

For example, the sync unit 100 may include an image display device such as a computer monitor, a liquid crystal display, an organic light emitting diode (OLED) display, a plasma display panel (PDP), or a television (TV) to receive and display image data. The source unit 200 includes a host such as a personal computer (PC) main body, a computer, a microprocessor, and a microcomputer capable of transmitting image data.

In order to reduce power consumption in a still image display state, the host 200 may instruct the image display device 100 to perform a panel self-refresh (PSR) operation such that the image display device 100 stores an image and repeatedly displays the stored image, or executes a driver to turn off a power supply to components of a graphics subsystem or to turn off a power supply to components of the image display device 100. The host 200 may transmit commands to the image display device 100 using extension packets transmitted through an interface to allow the image display device 100 to store the image and to turn off the power supply to the components.

An interface protocol packet unit of the host 200 may depend on a display port available from ANSI/TIA/EIA-644-A(2001) or low voltage differential signaling (LVDS). The display interface of the host 200 may include a Display Port (DP) or an LVDS compatible interface, and a parallel-in-serial-out (PISO) interface.

The DP interface may be issued by the Video Electronics Standards Association (VESA) to adopt an interface scheme by integrating the LVDS, which is an internal interface standard, and a Digital Visual Interface (DVI), which is an external connection standard. The DP interface refers to a technology capable of enabling an internal connection between chips and an external connection between products in a digital scheme. Since two interfaces are combined as one, a data bandwidth may be widened so that high color depth and a high resolution may be provided.

As an example, the DP interface may have a bandwidth of a maximum of 10.8 Gbps, which is at least twice greater than the bandwidth of an existing DVI (e.g., a maximum of 4.95 Gbps). The DP interface may simultaneously transfer a maximum of six 1080i streams (three 1080p streams) through one connector by supporting a multi-steam using a micro-packet architecture.

The Video Electronics Standard Association (VESA) provides an embedded display port ('eDP') standard. The eDP standard is an interface standard corresponding to a DP interface designed for devices equipped with a display such as a lap-top computer, a tablet PC, a net book, and an all-in-one desktop PC. For example, eDP v1.3 includes the PSR technology.

The PSR technology may improve the power saving function in a system and extend a life span of a battery in a portable PC environment. The PSR technology may display an image while minimizing power consumption using a memory installed in a display, thereby significantly increasing a usable time of a battery in a portable PC environment.

The image display device 100 includes a display control unit 110 and a display unit 120. The display control unit 110 may include an eDP receiver. The image display device 100 may communicate with the host 200 through an eDP interface. The display unit 120 includes a display panel 122, a data driving circuit 124, and a scan driving circuit 126.

The host 200 may transmit image data to the display control unit 110 included in the image display device 100 through an eDP transmitter. The display control unit 110 may receive image data through the eDP receiver and provide the image data to the display unit 120. Further, the display control unit 110 generates timing control signals for controlling operation timings of the data driving circuit 124 and the scan driving circuit 126 included in the display unit 120. An interface for transmitting data between the display control unit 110 and the data driving circuit 124 may be implemented as a mini LVDS interface, but exemplary embodiments are not limited thereto. The display control unit 110 may be configured as a display driver IC.

The display panel 122 includes a plurality of data lines and scan lines (or gate lines). In the display panel 122, the data lines intersect the scan lines (or gate lines). The display panel 122 includes pixels aligned in the form of a matrix defined by the data lines and the scan lines. A Thin Film Transistor (TFT) may be formed at intersections of the data lines and the scan lines. The display panel 122 may be implemented as a display panel of a flat panel display such as a Liquid Crystal Display (LCD), a Field Emission Display (FED), a Plasma Display Panel (PDP), an Electroluminescence Device (EL) including an inorganic electroluminescence device, an Organic Light Emitting Diode (OLED), and an Electrophoresis display device (EPD). When the display panel 122 is implemented as a display panel of the LCD, a backlight unit is required. The backlight unit may include a direct type backlight unit or an edge type backlight unit.

The data driving circuit 124 latches digital image data under the control of the display control unit 110. The data driving circuit 124 converts digital image data into data voltages to output the data voltages to the data lines. The scan driving circuit 126 sequentially supplies scan pulses synchronized with the data voltages to the scan lines under the control of the display control unit 110.

Figure 2:
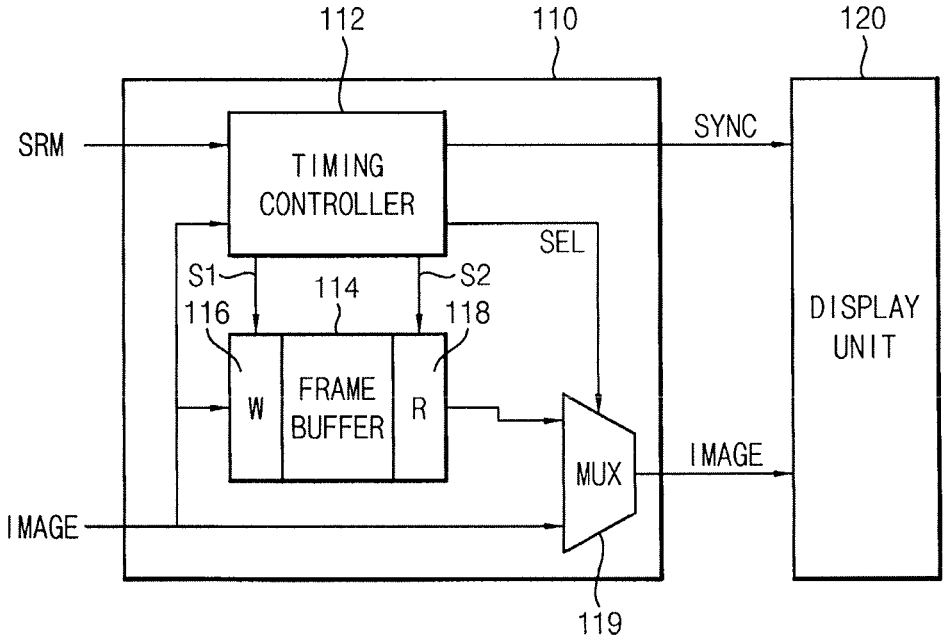
FIG. 2 is a block diagram illustrating a controller shown in FIG. 1 according to an exemplary embodiment of the inventive concept.

FIG. 2 is a block diagram illustrating the display control unit 110 shown in FIG. 1 according to an exemplary embodiment of the inventive concept.

Referring to FIG. 2, the display control unit 110 includes a Display Drive Integrated circuit (DDI) and peripheral circuit components mounted on a board. The display control unit 110 will be referred to as a DDI 110 herein.

The DDI 110 includes a timing controller 112, a frame buffer 114, a write circuit 116, a read circuit 118, and an output selector 119.

The DDI 110 has a capability to respond to commands from the host 200 to enter a self-refresh mode including the turn off of a power supply to components or the storage of an image to repeatedly output the stored image to a display unit. The timing controller 112 activates the write circuit 116 and the frame buffer 114 to store a frame of image data in response to a signal SRM from the host 200, and activates the read circuit 118 to read the stored frame of image data. In an exemplary embodiment, activation of the write circuit 116 and the frame buffer 114 means providing power to the write circuit 116 and the frame buffer 114 that is sufficient to power the respective devices. The timing controller 112 controls the output selector 119, for example, a multiplexer (MUX) with a control signal SEL so that still image data are transferred to an output port. Further, the timing controller 112 outputs a sync signal SYNC synchronized to the still image data.

If the still image display state is detected, the host 200 performs a preliminary check procedure for the PSR driving.

That is, the host 200 reads a "sink PSR Capability Display Port Configuration Data (DPCD) register" included in the timing controller 112 to determine PSR capability. Information indicating the PSR capability of the timing controller 112 is recoded in the "sink PSR Capability DPCD register". The timing controller 112 returns "sink PSR Capability" information to the host 200 according to a request of the host 200.

After confirming "sink PSR Capability" information, the host 200 updates a "sink PSR configuration DPCD register" included in the timing controller 112 to set a state such as "Source transmitter state in PSR active", "CRC verification in PSR active" and "Frame capture indication". If the update is achieved, the timing controller 112 transmits an "ACK" signal to the host 200.

Next, the timing controller 112 activates a PSR function recorded in the "sink PSR configuration DPCD register" according to the request of the host 200 and then transmits an "ACK" signal to the host 200. The host 200 transmits the still image data to the timing controller 112 so that the still image data are stored in a remote frame buffer (e.g., 114).

In an exemplary embodiment, after the frame buffer 114 stores the frame of image data, the DDI 110 activates a state signal to notify the host 200 that the storage of the image data has been achieved and the stored image is displayed.

The timing controller 112 deactivates the frame buffer 114 and associated logic after the SRM signal is deactivated, and controls the output selector 119, for example, the multiplexer MUX with a control signal SEL so that the multiplexer MUX 119 transfers an image input from an input port (in this case, LVDS RX) to an output port LVDS TX. In an exemplary embodiment, deactivation of the frame buffer 114 means that power needed to operate the frame buffer is suppressed or turned off.

When the image display system exits the self-refresh mode, a logic clock is gated and the frame buffer 114 is turned-off (e.g., deactivated), so the DDI 110 may use a smaller amount of power.

In the system having the above configuration, since the host 200 does not recognize frame synchronization of the image display device 100 during a self-refresh mode operation, resynchronization needs to be achieved between the host 200 and the image display device 100 when the image display system exits from the self-refresh mode.

Figure 3:
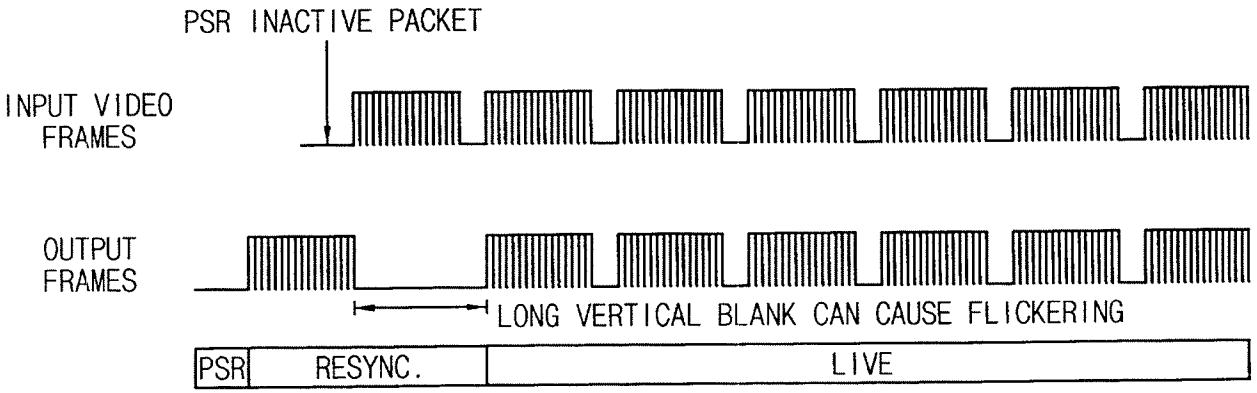
FIG. 3 is a diagram illustrating screen flickering during a resynchronization procedure when the image display system exits a self-refresh mode.

FIG. 3 is a diagram illustrating screen flickering during a resynchronization procedure when the image display system exits from a self-refresh mode.

In FIG. 3, reference symbol PSR signifies a panel self-refresh interval, reference symbol RESYNC. signifies a time interval where the system synchronizes with an input frame when the image display system exits the self-refresh mode and reference symbol LIVE signifies an interval where the input frame transmitted from the host 200 is displayed in the panel without using the frame buffer 114.

If a Vertical Blank Interval (VBI) is increased as shown in FIG. 3 for frame synchronization between the DDI 110 and the host 200 when the image display system exits the self-refresh mode, screen flickering occurs. In an exemplary embodiment, a VBI is the time period between consecutive frames of image data, where no image data is present.

Although a length of the VBI where the flickering occurs is determined according to physical properties of the display panel 120, if the frame synchronization is matched as shown in FIG. 3, there is a limitation in selection of the available display panel 120.

Therefore, at least one exemplary embodiment of the inventive concept provides a method of matching sync timing of the image display device 100 by itself when the host 200 does not know the sync timing of the image display device 100, which may display an image without screen flickering.

Figure 4:
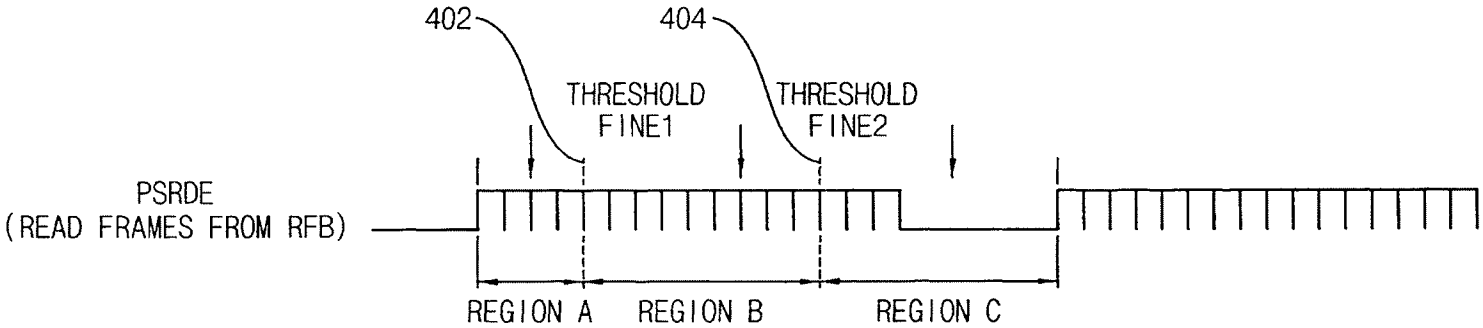
FIG. 4 is a diagram illustrating a threshold value for a frame synchronization control according to an exemplary embodiment of the inventive concept.

FIG. 4 is a diagram illustrating a threshold value for controlling frame synchronization according to an exemplary embodiment of the inventive concept.

Referring to FIG. 4, a first frame interval of an image signal read from the frame buffer 114 includes a region A, a region B, and a region C which are divided by a first threshold value 402 and a second threshold value 404. For example, the boundaries of the regions may be defined by the threshold values.

The first threshold value 402 is a maximum VBI allowed for one frame interval when extending the VBI. That is, the first threshold value 402 is used to determine whether a time difference is so small that the resynchronization is possible without a use of a memory (e.g., frame buffer 114). Accordingly, when the time difference is greater than the first threshold value 402, the memory needs to be used to prevent the flickering.

The second threshold value 404 is an interval where a maximum VBI obtained when the VBI is extended to reduce a frame rate lower than a frame rate of image data provided from the outside is set as the flickering interval. That is, the second threshold value 404 is used to determine whether the frame rate needs to be set higher or lower than the input frame rate when the memory is used. That is, the second threshold value 404 is used to set a range capable of preventing the flickering when the VBI is extended to lower a frame rate for resynchronization.

When the time difference becomes greater than the second threshold value 404, the frame rate is set to be greater than the input frame rate to realize resynchronization by shortening the blank interval.

In addition, it is determined where the display timing of the input frame transmitted from the host 200 is located from among the three regions A-C to control the resynchronization by adjusting the rate according to the timing of the transmitted input frame so that an image may be displayed without screen flickering.

The timing controller 112 may transmit a first signal S1 to the write circuit 116 and a second signal S2 to the read circuit 118. The first signal S1 may be used to active and deactivate the write circuit 116 and the second signal S2 may be used to activated and deactivate the read circuit 118. The timing controller 112 may adjust the frame read rate of the frame buffer 114 by controlling activations of the write and read circuits 116 and 118.

Figure 5:
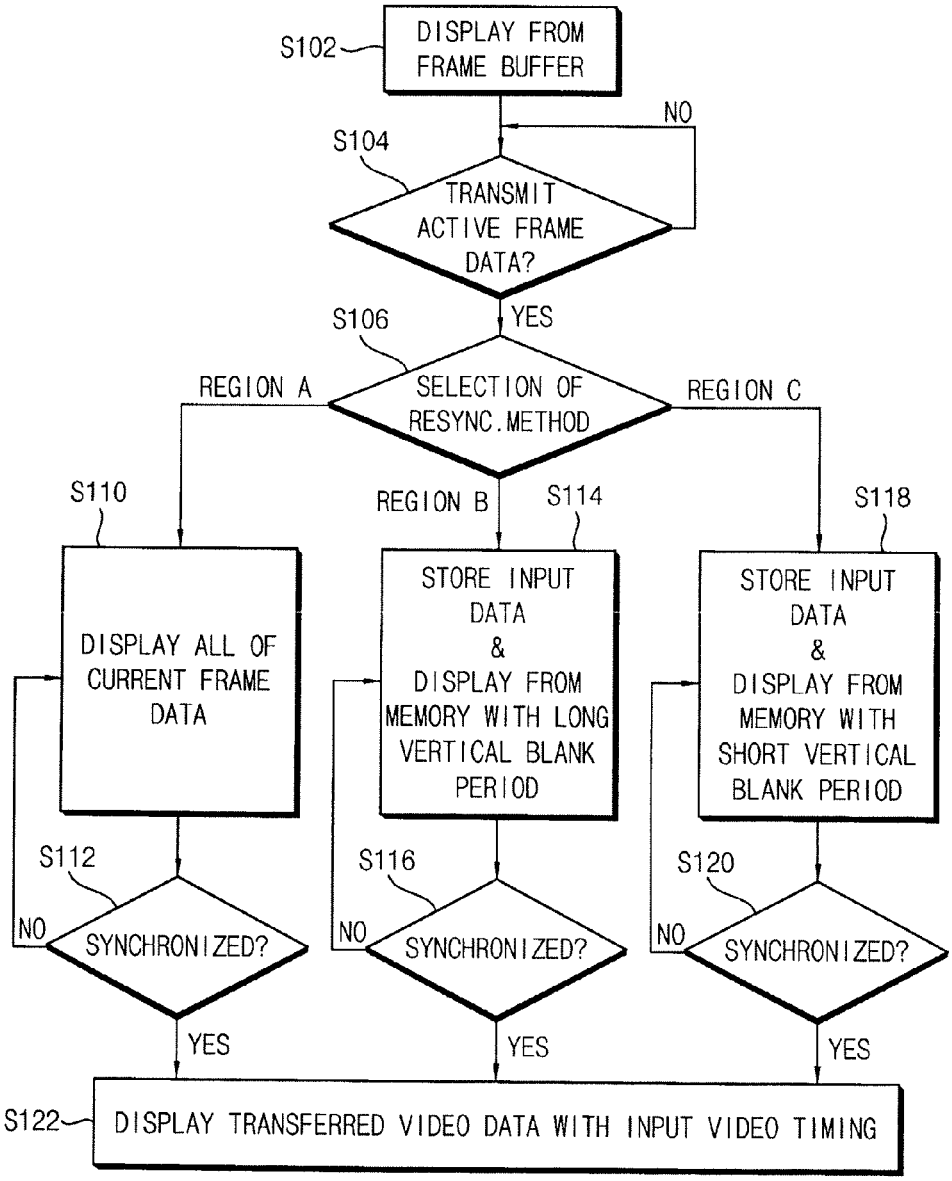
FIG. 5 is a flowchart illustrating a method of controlling resynchronization performed by a timing controller according to an exemplary embodiment of the inventive concept.
Figure 6:
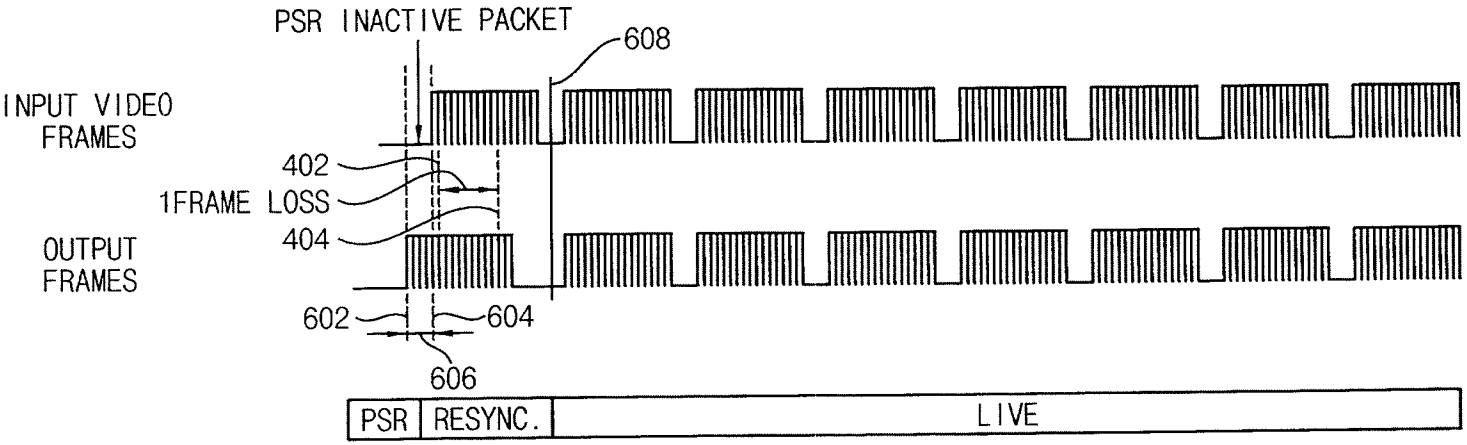
FIG. 6 is a diagram illustrating an example where a time difference between internal display timing and external display timing is less than a first threshold value.

FIG. 5 is a flowchart illustrating a method of controlling resynchronization performed by a timing controller 112 according to an exemplary embodiment of the inventive concept. FIG. 6 is a diagram illustrating an example where a time difference between internal display timing and external display timing is less than a first threshold value 402, FIG. 7 is a diagram illustrating an example where the time difference between the internal display timing and the external display timing is between the first threshold value 402 and the second threshold value 404, and FIG. 8 is a diagram illustrating an example where the time difference between the internal display timing and the external display timing is equal to or greater than the second threshold value 404.

Referring to FIG. 5, the timing controller 112 activates a control signal SEL in response to an SRM signal to control the MUX 119 to select image data output from the frame buffer 114. Further, the timing controller 112 repeatedly reads a stored still image from the frame buffer 114 and displays the read still image on the display panel 120 (S102). The timing controller 112 checks whether active frame data are transmitted from the host 200 during a self-refresh mode operation (S104). In an exemplary embodiment, the active frame data represents moving or changing images. For example, when the image data of a first frame differs by more than a threshold amount from image data of a second frame, it may be interpreted as active frame data or moving image data. When the active frame data are transmitted in step S104, the timing controller 112 compares display timing of an output frame with display timing of an input frame (S106). According to a condition shown in FIG. 4, the timing controller 112 calculates a time difference between internal display timing and external display timing and determines where the time difference is located from among three regions A, B, and C.

That is, as shown in FIG. 6, when a first time difference 606 between display timing 602 of an output frame and display timing 604 of an input frame is less than the first threshold value 402, it is determined that the first time difference 606 is included in region A.

Figure 7:
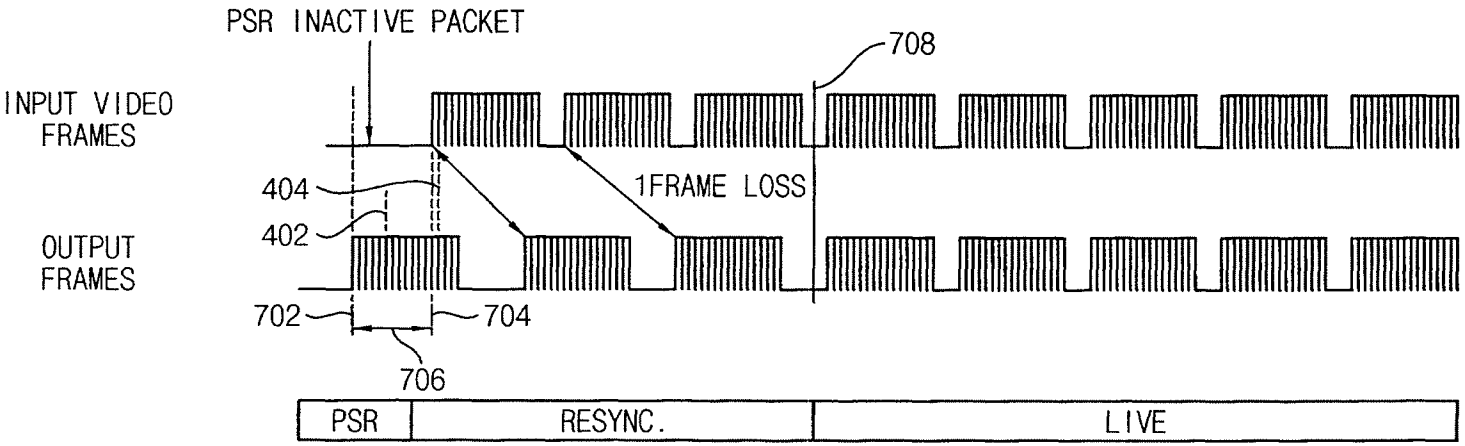
FIG. 7 is a diagram illustrating an example where the time difference between the internal display timing and the external display timing is between the first threshold value and the second threshold value.
Figure 8:
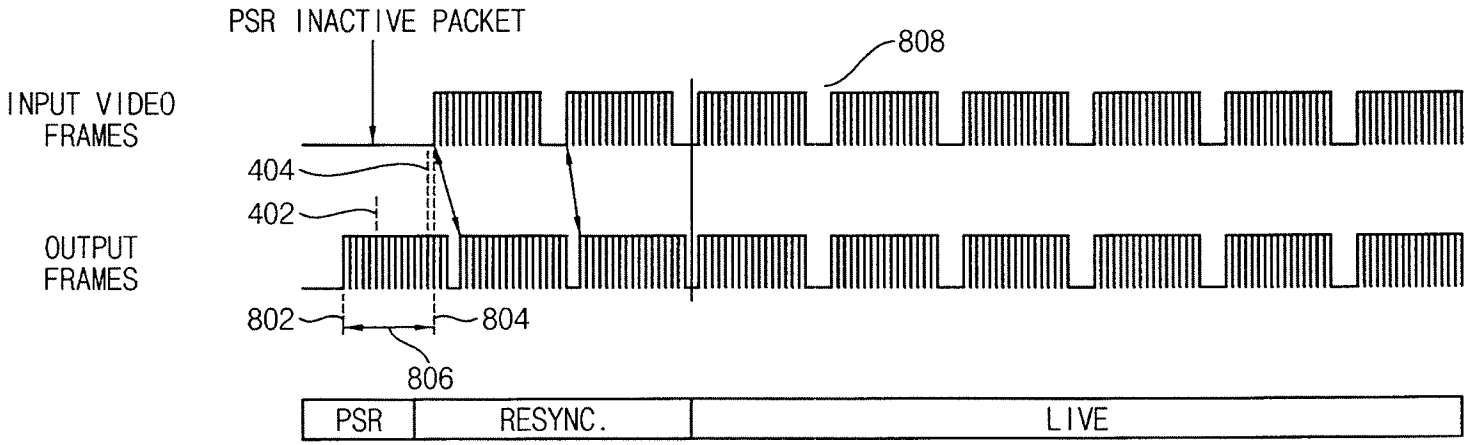
FIG. 8 is a diagram illustrating an example where the time difference between the internal display timing and the external display timing is equal to or greater than the second threshold value.

That is, as shown in FIG. 7, when a second time difference 706 between display timing 702 of the output frame and display timing 704 of the input frame is between the first threshold value 402 and the second threshold value 404, it is determined that the second time difference 706 is included in region B.

That is, as shown in FIG. 8, when a third time difference 806 between display timing 802 of an output frame and display timing 804 of an input frame is equal to or greater than the second threshold value 404, it is determined that the third time difference 806 is included in region C.

When a time difference is less than the threshold value 402, that is, when the time difference is included in region A (see FIG. 6), the timing controller 112 outputs current frame data stored in the frame buffer 114 without storing input image data in the frame buffer 114 and extends the blank interval to control resynchronization (S110). If the resynchronization is achieved through step S110 (S112), the timing controller 112 deactivates the control signal SEL at the resynchronized time 608 to control the MUX 119 to select image data provided from the host 200. Accordingly, the image data provided from the host 200 is displayed on the display panel 120 in a state where one frame is lost during the resynchronization procedure (S122).

When the time difference is between the first threshold value 402 and the second threshold value 404, that is, when the time difference is included in region B (see FIG. 7), the timing controller 112 stores input image data in the frame buffer 114, and reads the stored image data from the frame buffer 114 at a rate lower than the input frame rate, that is, in a long VBI (S114). Through the above procedure, the timing controller 112 performs the resynchronization (S116) and deactivates a control signal SEL at the resynchronized time 708 to control the MUX 119 to select image data transmitted from the host 200. Accordingly, the image data transmitted from the host 200 is displayed on the display panel 120 (S122).

When the time difference 806 is equal to or greater than the second threshold value 404, that is, when the time difference 806 is included in region C (see FIG. 8), the timing controller 112 stores input image data in the frame buffer 114 and reads the stored image data from the frame buffer 114 at a rate higher than the input frame rate, that is, in a short blank interval (S118). Through the above procedure, the timing controller 112 performs the resynchronization (S116) and deactivates a control signal SEL at the resynchronized time 808 to control the MUX 119 to select image data transmitted from the host 200. Accordingly, the image data transmitted from the host 200 is displayed on the display panel 120 (S122).

While the DDI 110 has been illustrated in FIG. 2 as having a particular arrangement of logic circuits, the invention concept is not limited thereto.

At least one embodiment of the inventive concept can be embodied as computer-readable codes having computer executable instructions on a computer-readable medium. For example, the operations of FIG. 5 may be embodied as computer executable instructions. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices.

The foregoing is illustrative of the present inventive concept and is not to be construed as limiting thereof. Although a few exemplary embodiments of the inventive concept have been described, many modifications are possible in the exemplary embodiments without materially departing from the present inventive concept. Accordingly, all such modifications are intended to be included within the scope of the present inventive concept.

What is claimed is:

1. A display drive integrated circuit comprising:

a frame buffer;

an output selector configured to selectively output one of image data read from the frame buffer and image data transmitted from a source external to the display drive integrated circuit; and a timing controller configured to control output of the image data read from the frame buffer to a display panel in a self-refresh mode, and control internal display timing to track external display timing when the display drive integrated circuit exits the self-refresh mode to control the output selector to output the image data transmitted from the source to the display panel when the internal display timing is synchronized to the external display timing, wherein the timing controller begins extending a vertical blank interval of the internal display timing before the output selector is controlled to output the image data transmitted from the source to the display panel when a first time difference between the external display timing and the internal display timing is less than a first threshold.

2. The display drive integrated circuit of claim 1, wherein the timing controller controls the output selector to output the image data transmitted from the source to the display panel in a state where the external display timing is synchronized with the internal display timing by extending the vertical blank interval of the internal display timing by the first time difference, and where the timing controller stores the image data transmitted from the source in the frame buffer and controls the output selector to output the image data transmitted from the source to the display panel in a state where a rate of reading frames of image data (frame read rate) from the frame buffer is synchronized with a rate of transmitting frames of image data (frame transmission rate) from the source by one of increasing and reducing the frame read rate from the frame buffer to track the frame transmission rate of the image data transmitted from the source in response to a second time difference between the external display timing and the internal display timing when the second time difference is equal to or greater than the first threshold value.

3. The display drive integrated circuit of claim 2, wherein the timing controller stores image data transmitted from the source in the frame buffer and controls the output selector to output the image data transmitted from the source to the display panel in a state where the frame read rate from the frame buffer is synchronized with the frame transmission rate of the image data transmitted from the source by reducing the frame read rate from the frame buffer to be lower than the frame transmission rate of the image data transmitted from the source when the second time difference is equal to or greater than the first threshold value and is less than the second threshold value, and wherein the timing controller stores image data transmitted from the source in the frame buffer, and controls the output selector to output the image data transmitted from the source to the display panel in a state where the frame read rate from the frame buffer is synchronized with the frame transmission rate of the image data transmitted from the source by increasing the frame read rate from the frame buffer to be greater than the frame transmission rate of the image data transmitted from the source when the second time difference is equal to or greater than the second threshold value.

4. The display drive integrated circuit of claim 3, wherein the first threshold value is a maximum vertical blank interval allowed for one frame interval when a vertical blank interval is extended.

5. The display drive integrated circuit of claim 3, wherein the second threshold value is an interval where a maximum vertical blank interval obtained when the vertical blank interval is extended to reduce a frame rate to be lower than the frame transmission rate of image data transmitted from the source is set as a flickering interval.

6. An image display system comprising:

an image display device; and a host configured to control the image display device to operate in a self-refresh mode when the image display device displays a still image, wherein the image display device comprises:

a display panel configured to display an image; and a display drive integrated circuit comprising a frame buffer, a timing controller, and an output selector, the display drive integrated circuit configured to display the still image on the display panel with internal display timing in the self-refresh mode, and drive the display panel during a first period according to image data transmitted from the host such that the internal display timing is synchronized with external display timing of image data transmitted from the host by controlling the internal display timing to track the display timing of the image data during a second period after the image display device exits from the self-refresh mode and before the first period, wherein the timing controller adjusts a rate at which frames of image data are read from the frame buffer (a frame read rate) during the second period when a first time difference between the external display timing and the internal display timing is equal to or greater than a first threshold value.

7. The image display system of claim 6, wherein the display drive integrated circuit comprises:

the output selector configured to selectively output one of image data read from the frame buffer and image data transmitted from the source; and the timing controller configured to control output of the image data read from the frame buffer to the display panel in the self-refresh mode, and control the internal display timing to track the external display timing when the display drive integrated circuit exits the self-refresh mode to control the output selector to output the image data transmitted from the source to the display panel when the internal display timing is synchronized to the external display timing.

8. The image display system of claim 7, wherein the timing controller controls the output selector to output the image data transmitted from the source to the display panel in a state where the external display timing is synchronized with the internal display timing by extending a vertical blank interval of the internal display timing by a second time difference between the external display timing and the internal display timing when the second time difference is less than a first threshold value, and wherein the timing controller stores the image data transmitted from the source in the frame buffer and controls the output selector to output the image data transmitted from the source to the display panel in a state where the frame read rate from the frame buffer is synchronized with a rate of transmitting frames of image data (frame transmission rate) from the source by one of increasing and reducing the frame read rate from the frame buffer to track the frame transmission rate of the image data transmitted from the source in response to the first time difference between the external display timing and the internal display timing when the first time difference is equal to or greater than the first threshold value.

9. The image display system of claim 8, wherein the timing controller stores image data transmitted from the source in the frame buffer and controls the output selector to output the image data transmitted from the source to the display panel in a state where the frame read rate from the frame buffer is synchronized with the frame transmission rate of the image data transmitted from the source by reducing the frame read rate from the frame buffer to be lower than the frame transmission rate of the image data transmitted from the source when the first time difference is equal to or greater than the first threshold value and is less than the second threshold value, and the timing controller stores image data transmitted from the source in the frame buffer, and controls the output selector to output the image data transmitted from the source to the display panel in a state where the frame read rate from the frame buffer is synchronized with the frame transmission rate of the image data transmitted from the source by increasing the frame read rate from the frame buffer to be greater than the frame transmission rate of the image data transmitted from the source when the first time difference is equal to or greater than the second threshold value.

10. The image display system of claim 9, wherein the first threshold value is a maximum vertical blank interval allowed for one frame interval when a vertical blank interval is extended.

11. The image display system of claim 9, wherein the second threshold value is an interval where a maximum vertical blank interval obtained when the vertical blank interval is extended to reduce a frame rate to be lower than the frame transmission rate of image data transmitted from the source is set as a flickering interval.

12. The image display system of claim 6, wherein the host is connected to the display drive integrated circuit through a display port interface or an embedded display port interface.

13. A display drive integrated circuit comprising:

a controller configured to receive external image data and determine a timing based on the received image data;

a frame buffer configured to receive the external image data, wherein the controller is configured to perform one of i) forwarding of the external image data to a display panel or ii) storing the external image data in the frame buffer, reading of the image data from the frame buffer, and forwarding of the read image data to the display panel, based on the determined timing, wherein the controller determines the timing by comparing the received image data to the forwarded image data to determine a difference, wherein when the difference is greater than a first threshold and less than a second threshold, the controller reads the image data from the frame buffer at a rate lower than a rate at which the external image data is received, and wherein when the difference is greater than the second threshold and less than a third threshold, the controller reads the image data from the frame buffer at a rate higher than a rate at which the external image data is received.

14. The display drive integrated circuit of claim 13, wherein when the difference is less than a first threshold, the controller forwards the external image data to the display panel, and otherwise stores the external image data in the frame buffer, reads the image data from the frame buffer, and forwards the read image data to the display panel.

15. The display drive integrated circuit of claim 13, wherein the controller deactivates the frame buffer when it determines it will forward the external image data to the display panel.

16. The display drive integrated circuit of claim 13, further comprising a multiplexer receiving the external image data and an output of the frame buffer, and controlled by a control signal based on the timing.

17. The display drive integrated circuit of claim 13, wherein the controller only performs the storing, reading, and forwarding upon exiting a self-refresh mode.

* * * * *